US007674092B2

(12) United States Patent
Annerfeldt et al.

(10) Patent No.: US 7,674,092 B2
(45) Date of Patent: Mar. 9, 2010

(54) BLADE OR VANE FOR A TURBOMACHINE

(75) Inventors: Mats Annerfeldt, Finspong (SE); Andrey Shukin, Finspong (SE); Sergey Shukin, Finspong (SE)

(73) Assignee: Siemens Aktiengesellschaft, Munich (DE)

( * ) Notice: Subject to any disclaimer, the term of this patent is extended or adjusted under 35 U.S.C. 154(b) by 777 days.

(21) Appl. No.: 10/590,463

(22) PCT Filed: Feb. 25, 2005

(86) PCT No.: PCT/EP2005/050804

§ 371 (c)(1),
(2), (4) Date: Aug. 23, 2006

(87) PCT Pub. No.: WO2005/083235

PCT Pub. Date: Sep. 9, 2005

(65) Prior Publication Data

US 2007/0172354 A1 Jul. 26, 2007

(30) Foreign Application Priority Data

Feb. 27, 2004 (SE) ..... 0400477

(51) Int. Cl.
*F01D 5/18* (2006.01)

(52) U.S. Cl. ..... 416/97 R

(58) Field of Classification Search ..... 415/115; 416/96 R, 97 R, 233

See application file for complete search history.

(56) References Cited

U.S. PATENT DOCUMENTS

| | | | | |
|---|---|---|---|---|
| 3,017,159 | A | 1/1962 | Foster et al. | |
| 3,635,587 | A * | 1/1972 | Giesman et al. | 416/97 R |
| 3,806,274 | A | 4/1974 | Moore | |
| 4,407,632 | A * | 10/1983 | Liang | 416/97 R |
| 4,526,512 | A * | 7/1985 | Hook | 416/96 A |
| 5,243,759 | A | 9/1993 | Brown et al. | |
| 5,919,031 | A * | 7/1999 | Hall et al. | 416/96 R |
| 6,382,907 | B1 | 5/2002 | Bregman et al. | |

FOREIGN PATENT DOCUMENTS

| | | |
|---|---|---|
| GB | 1 404 757 A | 9/1975 |
| GB | 1 410 014 A | 10/1975 |
| RU | 2 042 833 C1 | 8/1995 |
| RU | 1 228 559 A1 | 10/1996 |
| SU | 779 590 A1 | 11/1980 |

* cited by examiner

*Primary Examiner*—Edward Look
*Assistant Examiner*—Nathaniel Wiehe

(57) ABSTRACT

A component defines a blade or a vane for a rotor rotatable about a rotary axis. An inner space of the component is limited by first and second walls, and forms a passage for a cooling fluid. First and second ribs project form the first and second walls, respectively, and form first and second channels for the fluid from a leading end to a trailing end of the ribs. The first and second ribs intersect and are directly connected to each other at said intersections. The first and second ribs intersect at an intersection joint in the proximity of the trailing end in such a way that the first channel and the second channel form a common outlet channel with a flow area.

19 Claims, 5 Drawing Sheets

BLADE OR VANE FOR A TURBOMACHINE

CROSS REFERENCE TO RELATED APPLICATIONS

This application is the US National Stage of International Application No. PCT/EP2005/050804, filed Feb. 25, 2005 and claims the benefit thereof. The International Application claims the benefits of Swedish Patent application No. 0400477-6 filed Feb. 27, 2004. All of the applications are incorporated by reference herein in their entirety.

FIELD OF THE INVENTION

The present invention refers generally to a component for a turbo machine, especially a gas turbine having a rotor which is rotatable around a rotary axis. The component includes a guide vane or a rotor blade for the gas turbine.

In particular, the present invention refers to a component defining one of a blade and a vane for a rotary machine having a rotor, which is rotatable about a rotary axis, the component comprising an inner space, which is limited by first wall and a second wall facing each other and which has an inlet and an outlet, wherein the inner space forms a passage for a cooling fluid from the inlet to the outlet, at least first ribs, projecting form the first wall and extending substantially in parallel to each other to form first channels for the fluid from a leading end of the first ribs to a trailing end of the first ribs, and second ribs, projecting form the second wall and forming second channels for the fluid from the leading end of the second ribs to the trailing end of the second ribs, wherein the first ribs and the second ribs intersect each other and are directly connected to each other at said intersections.

BACKGROUND OF THE INVENTION

It is known from for instance U.S. Pat. No. 6,382,907 to provide a cooling system for such a component, which includes first and second ribs placed on the first wall and second wall, respectively, i.e. on the suction side and the pressure side, at different inclination angles in relation to the rotary axis of the machine and in relation to the flow direction of the cooling air. The ribs form a matrix of channels for the cooling fluid flowing through the component. The ribs connect at their intersections to each other and to a central plane of the component. In this prior art document, the component has a leading set of ribs and trailing sets of ribs which either are connected to each other or are divided from each other.

Although this prior art cooling system is able to provide an efficient cooling of the component, it may happen, in case the cooling fluid is not perfectly clean, that foreign particles in the cooling fluid may be caught in the matrix. In a worse scenario, some of the matrix channels can be plugged close to the trailing edge, thus reducing the cooling performance of the system. Furthermore, since the ribs are joined at the central plane of the component, the height of the cooling channels is merely 50% of the total height, i.e. distance between two walls of a component, available for the cooling system. This is especially critical at the trailing edge of the component, where the height of the cooling passage is the smallest in the whole component.

SU-A-1228559 discloses a rotor blade for a rotary machine. The blade comprises an inner space, forming a passage for a cooling fluid and limited by first and second walls facing each other. Ribs project form said walls and extend substantially in parallel to each other to form first channels for said fluid from a leading inlet part of the inner space to a trailing outlet part of the inner space. The ribs are divided into a leading set of ribs in the leading inlet part and a trailing set of ribs in the trailing outlet part. The leading set of ribs extend in a first direction forming a first angle of inclination to the rotary axis of the machine in said leading part. The trailing set of ribs extend in a second direction forming a second angle of inclination to the rotary said axis in said trailing part. The trailing end of some of the ribs in the leading set of ribs are following a curved path to have a decreasing angle of inclination.

RU-C1-2042833 discloses another blade for a rotary machine. The blade comprises an inner space, forming a passage for a cooling fluid and limited by first and second walls facing each other. Ribs project form said walls and extend substantially in parallel to each other to form first channels for said fluid from a leading inlet part of the inner space to a trailing outlet part of the inner space. The ribs are divided into a leading set of ribs in the leading inlet part and a trailing set of first ribs in the trailing outlet part. The leading set of ribs extend in a first direction forming a first angle of inclination to the rotary axis of the machine in said leading part. The trailing set of ribs extend in a second direction forming a second angle of inclination to the rotary said axis in said trailing part. The first angle is clearly smaller than the second angle.

U.S. Pat. No. 3,806,274 discloses a rotor blade for a gas turbine, which has first ribs on an inner wall and opposite second ribs on an opposite wall. However, the first and second ribs are separated from each other by an insert plate in such a way that the flow channels formed between the first ribs are completely separated from the flow channels form between the second ribs.

SUMMARY OF THE INVENTION

An object of the present invention is to provide an improved component suitable for use as a rotor blade or a guide vane in a rotary machine. A further object is to provide a component which exhibits a favourable flow of the fluid from the component. A further object is to provide a component which has a high resistance to dust and other particles in the cooling fluid. A further object is to provide such a component which exhibits low aerodynamic losses in the cooling fluid flow. A further object is to provide a component which exhibits a high mechanical strength and a high mechanical integrity.

These and other object are achieved by the component initially defined, which is characterised in that the first and second ribs intersect at an intersection joint in the proximity of the trailing end in such a way that the first channel and the second channel form a common outlet channel with a flow area.

By such a component the flow of the fluid leaving the component at the trailing edge will be well defined. It is possible to achieve a flow in a desired direction from the component, for instance straight rearwardly in a direction being substantially parallel to the rotary axis. The flow may also be directed somewhat upwardly, i.e. away from the rotary axis or somewhat downwardly, i.e. towards the rotary axis. Furthermore, the contact between pressure side and suction side of the component is improved considerably at the proximity of trailing end due to the aligned extension of the ribs. This provides a bigger area of contact which in turn provides a higher heat flux between different sides of the component and reduces the temperature differences between the sides. As a result, thermal stresses in the proximity of the trailing edge decrease.

According to an embodiment of the invention, each such common outlet channel includes means for providing a reduction of the flow area in the proximity trailing end. As an example, the first and second ribs may have a main thickness along their extension, wherein the first and second ribs at the intersection joint have a thickness being larger than the main thickness, thereby providing said reduction of the flow area of the common channels. By such a design, the cooling efficiency at the trailing edge may be improved. Moreover, the mechanical strength of the component may be enhanced.

According to a further embodiment of the invention, each of the common outlet channels has a height measured from the first wall to the second wall, wherein each of the first channel and second channel has a height extending from the first wall and second walls, respectively, to the second ribs and first ribs, respectively. Thanks to the parallel extension of the ribs at the trailing end, the height of the common channel is thus increased in comparison to the prior art design. Since the component in the proximity of the trailing edge normally has the smallest height of the cooling passage, this design considerably reduces the possibility of channels being clogged by foreign objects.

According to a further embodiment of the invention, the first ribs extends in parallel to each other and that the second ribs extends in parallel to each other. Furthermore, the first ribs may extend from the leading end to the trailing end along a first direction in the proximity of the leading end and along a second direction in the proximity of the trailing end, wherein the first direction is inclined in relation to the second direction and wherein the component is adapted to be mounted to the rotor in such a way that the first direction forms a first angle of inclination to the rotary axis. Advantageously, the first ribs may extend from the leading end to the trailing end along a substantially continuously curved path. By means of such a continuously curved path, the channels will be smooth ensuring small aerodynamic losses of the cooling fluid flow. Furthermore, the smooth channels reduces the risk that dust and other particles get clogged in the inner space, more precisely in the matrix of channels in the inner space. The proposed solution also ensures a high mechanical integrity of the component due to the continuous change of the inclination of the ribs, since the solution provides a continuous structure without any sharp angles that can serve as stress concentrators.

According to a further embodiment of the invention, also the second ribs extend from the leading end to the trailing along a third direction in the proximity of the leading end and along a fourth direction in the proximity of the trailing end, wherein the third direction is inclined in relation to the fourth direction and wherein the component is adapted to be mounted to the rotor in such a way that the third direction forms a third angle of inclination to the rotary axis. In a corresponding manner, the second ribs may extend from the leading end to the trailing end along a substantially continuously curved path. By such a crossing channel arrangement in the matrix of channels in the inner space, the cooling fluid may be uniformly distributed in the component to provide an efficient cooling of the whole component. The first ribs will then promote turbulence in the second channels and the second ribs will promote turbulence in the first channels. It is to be noted that the third direction may also be substantially parallel to the fourth direction and to the rotary axis. It is advantageous that the third direction crosses the first direction.

According to a further embodiment of the invention, the second direction is substantially parallel the fourth direction. The channels formed by the first ribs and the channels formed by the second ribs may then extend in parallel to each other in the proximity of the trailing end and form a common outlet channel. Moreover, the second direction and the fourth direction may be substantially parallel to the rotary axis. Thus the common channels will extend substantially in parallel with the rotary axis. However, it is also possible to let the second direction and the fourth direction be slightly inclined with respect to the rotary axis, in particularly this inclination may vary along the trailing end of the component in such a way that the common outlet channels slopes somewhat downwards towards the rotary axis at a bottom portion of the component, is substantially parallel to the rotary axis at a middle portion of the component and slopes somewhat upwards away from the rotary axis at a top portion of the component. In such a way a fluid flow from the outlet of the component will diverge.

According to a further embodiment of the invention, the first direction intersects with the third direction. Thereby, the first ribs may be directly connected to the second ribs where the directions intersect each other wherein the fluid may flow from the first channels to the second channels and vice versa. By such an arrangement, a high strength of the component may be ensured and at the same time the volume of the inner space may be utilised for the flow of the cooling flow.

According to a further embodiment of the invention, the component is adapted to be mounted to the rotor in such a way that the third direction slopes from the leading end towards the rotary axis. Moreover, the component may be adapted to mounted to the rotor in such a way that the first direction slopes from the leading end away from the rotary axis. This means that the cooling fluid will flow along a smooth inclined path from the inlet provided in the proximity of the root of the component to the trailing edge of the component.

According to a further embodiment of the invention, the component is adapted to be mounted to the rotor in such a way that the first ribs are provided on a pressure side of the component and that the second ribs are provided on a suction side of the component. By such an arrangement of the ribs, the heat transfer intensification of the cooling fluid will be greater on the pressure side of the component, which in case the component is a rotor blade is advantageous since the cooling effect on the pressure side, which has a higher temperature than the suction side of the rotor blade, is increased. The absolute values of the angles of the first and third directions may be different, but are according to an embodiment of the invention substantially equal. The angles of the first and third directions may be 30-80°, preferably 50-80°, and most preferably 60-70°.

According to a further embodiment of the invention, the first and second ribs extend over a leading zone extending from the leading end and a trailing zone extending from the trailing end. The component may also include additional first ribs projecting form the first wall and extending substantially in parallel to each other over the trailing zone to the trailing end, wherein the additional first ribs extend in parallel with the first ribs in such a way that substantially every additional first rib is provided between two respective adjacent first ribs, thereby dividing substantially every one of the first channels into two parallel part channels extending over the trailing zone. Moreover, the component may includes additional second ribs projecting form the second wall and extending substantially in parallel to each other over the trailing zone to the trailing end, wherein the additional second ribs extend in parallel with the second ribs in such a way that substantially every additional second rib is provided between two respective adjacent second ribs, thereby dividing substantially every one of the second channels into two parallel part channels extending over the trailing zone.

According to a further embodiment of the invention, the additional first and second ribs intersect at an intersection joint in the proximity of the trailing end in such a way that each of the part channels from the first channels together with one of the part channels from the second channels form a common outlet channel with a flow area. Also the additional first and second ribs may have a main thickness along their extension, wherein the additional first and second ribs at the intersection joint have a thickness being larger than the main thickness, thereby providing a reduction of the flow area of the common channels. The additional ribs limit the area of the cooling channels in the proximity of the trailing edge and provide better cooling of the walls of the rotor blade due to the increased surface area. The aerodynamic losses caused by the additional ribs may be kept at a low level due to the smooth change of the inclination angle at the positions of the additional ribs.

According to a further embodiment of the invention, the inner space extends along a centre axis of the component from a bottom portion adjacent the inlet to an opposite top portion. The inner space downstream the inlet and upstream the leading end of the ribs includes a distribution chamber adapted to distribute the cooling fluid from the inlet to substantially all of the channels. The distribution chamber may extend from the bottom portion to the top portion.

BRIEF DESCRIPTION OF THE DRAWINGS

The present invention is now to be explained more closely by means of the description of various embodiments and with reference to the drawings attached hereto.

DETAILED DESCRIPTION OF THE INVENTION

Figure 1:
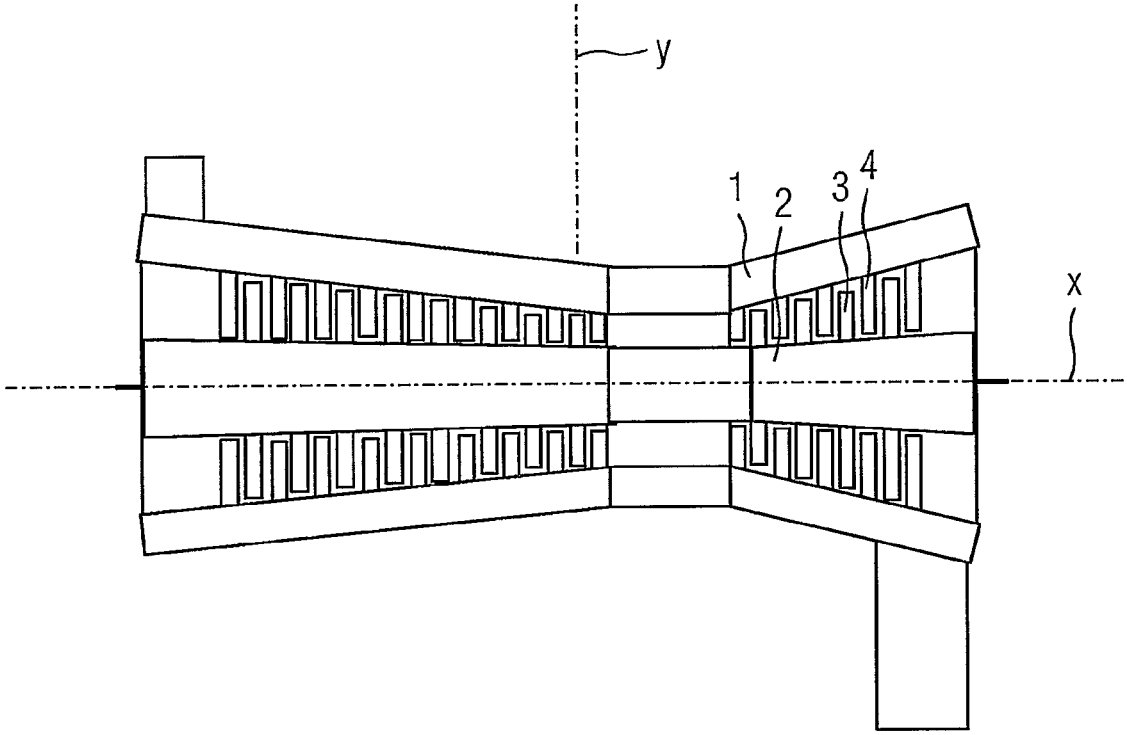
FIG. 1 shows a longitudinal sectional view through a gas turbine.

FIG. 1 discloses schematically a gas turbine having a stationary housing 1 and a rotor 2, which is rotatable in the housing 1 around a rotary axis x. The gas turbine includes a number of rotor blades 3 mounted to the rotor 2 and a number of stationary guide vanes 4 mounted to the housing 1.

Each of the rotor blades 3 and the guide vanes 4 thus forms a component of the gas turbine. Although, the following description refers to a component in the form of a rotor blade 3, it should be noted that the invention is also applicable to a guide vane 4 and that the characteristic features to be described in the following may also be included in a stationary guide vane 4.

Figure 2:
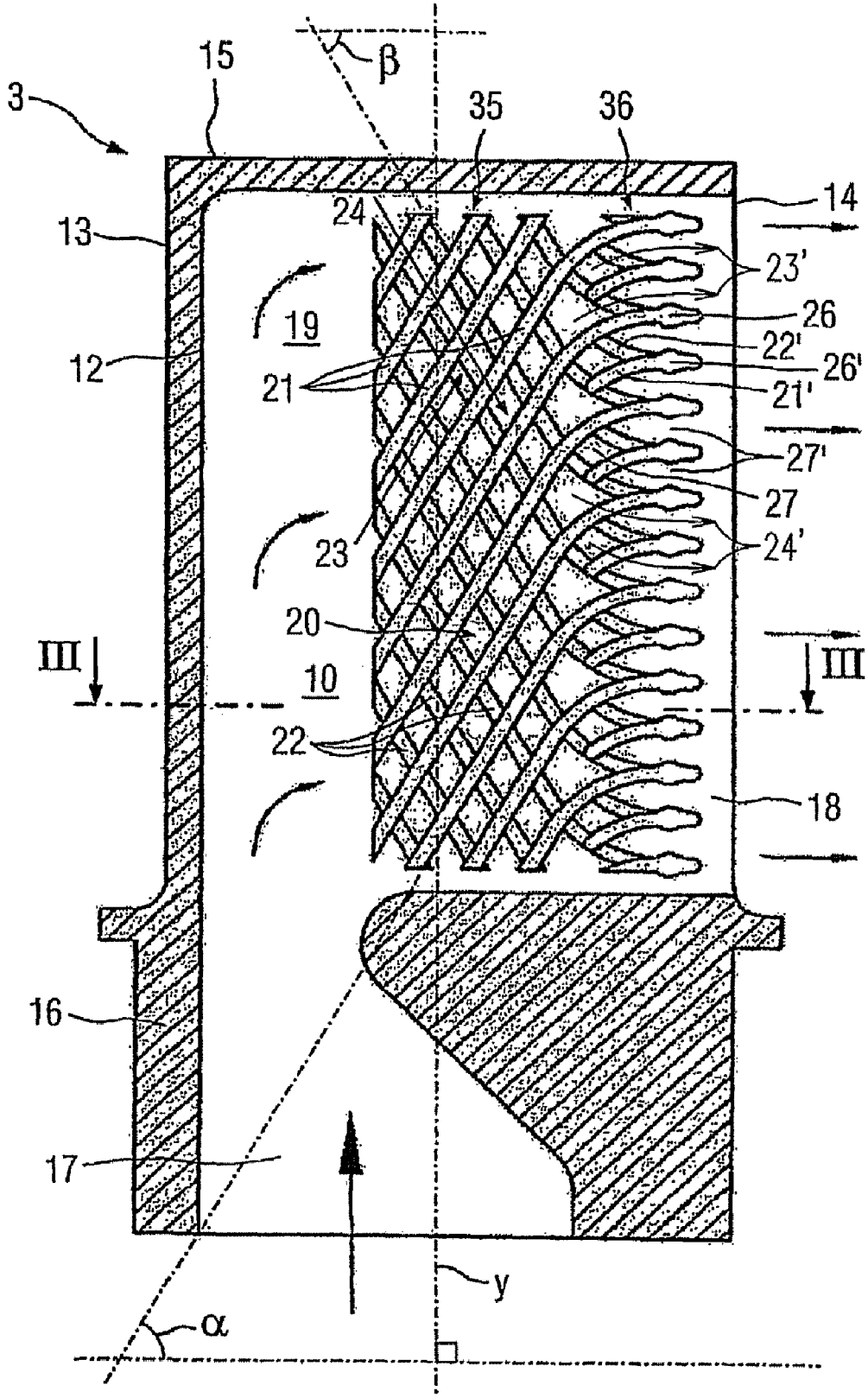
FIG. 2 shows an axial sectional view through a rotor blade of the gas turbine.
Figure 3:
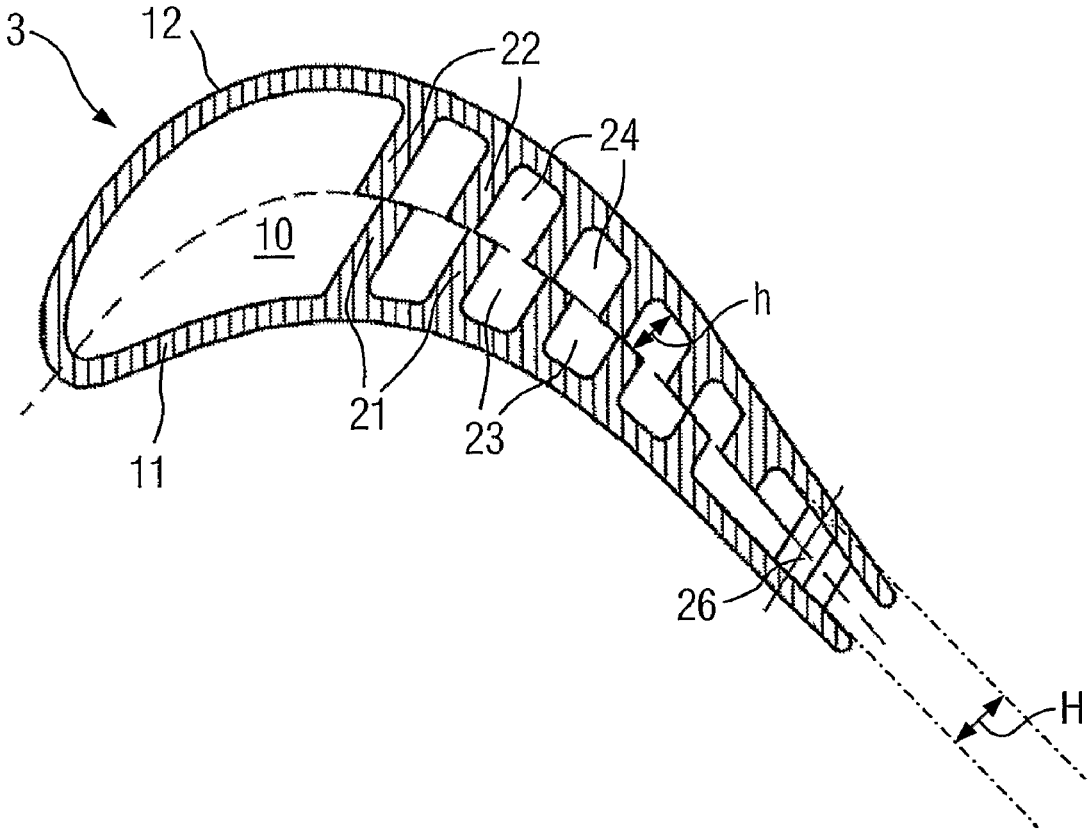
FIG. 3 shows a cross-sectional view through the rotor blade along the lines III-III in FIG. 2.

The component, i.e. in this case the rotor blade 3, is disclosed more closely in FIGS. 2 and 3. The rotor blade 3 includes an inner space 10, which is limited by first wall 11 and an opposite second wall 12. The first wall 11 and the second wall 12 face each other. The first wall 11 is provided at the pressure side of the rotor blade 3 whereas the second wall 12 is provided at the suction side of the rotor blade 3. Furthermore, the rotor blade 3 has a leading edge 13, a trailing edge 14, a top portion 15 and a bottom portion 16. The bottom portion 16 forms the root of the rotor blade 3. The rotor blade 3 is mounted to the body of the rotor 2 in such a way that the root is attached to the body of the rotor 2 whereas the top portion 15 is located at the radially outermost position of the rotor 2. The rotor blade 3 extends along a centre axis y extending through the rotor 2 from the bottom portion 16 to the top portion 15 substantially in parallel with the leading edge 13 and the trailing edge 14. The centre axis y is substantially perpendicular to the rotary axis x.

The rotor blade 3 has an inlet 17 to the inner space 10 and an outlet 18 from the inner space 10. The inlet 17 is provided at the bottom portion 16 and the outlet 18 at the trailing edge 14. The inner space 10 thus forms a passage for a cooling fluid from the inlet 17 to the outlet 18. The inner space 10 extends in a substantially radial direction with respect to the rotary axis x and in parallel with the centre axis y from the bottom portion 16 to the top portion 15. The inner space 10 includes a distribution chamber 19 and a matrix 20 of channels. The distribution chamber 19 is positioned inside and in the proximity of the leading edge 13 and extends from the inlet 17 in parallel to the centre axis y. The matrix 20 of channels is positioned between the distribution chamber 19 and the trailing edge 14. The matrix 20 of channels extends from the bottom portion 16 to the top portion 15.

The matrix 20 of channels of the rotor blade 3 is formed by first ribs 21, projecting form the first wall 11, and second ribs 22, projecting form the second wall 12. The first ribs 11 extend substantially in parallel to each other to form first channels 23 for the fluid from a leading end of the matrix 20 of channels to a trailing end of the matrix 20 of channels. The second ribs 22 extend substantially in parallel to each other to form second channels 24 for the fluid from the leading end of the matrix 20 of channels to the trailing end of the matrix 20 of channels.

The first ribs 21 extend from the leading end of the matrix 20 of channels to the trailing end of the matrix 20 of channels along a substantially continuously curved path. This path has such a curvature that the first ribs 21 extend along a first direction in the proximity of the leading end of the first ribs 21 and along a second direction in the proximity of the trailing end of the first ribs 21. The first direction is inclined in relation to the second direction. The first direction forms a first angle $\alpha$ of inclination to the rotary axis x. The second direction is substantially parallel to the rotary axis x, and thus substantially perpendicular to the centre axis y.

The second ribs 22 extend from the leading end of the matrix 20 of channels to the trailing end of the matrix 20 of channels along a substantially continuously curved path. This path has such a curvature that the second ribs 22 extend along a third direction in the proximity of the leading end of the matrix 20 of channels and along a fourth direction in the proximity of the trailing end of the rib matrix 20. The third direction is inclined in relation to the fourth direction. The third direction forms a third angle $\beta$ of inclination to the rotary axis x. The fourth direction is substantially parallel to the rotary axis x and the second direction, and thus substantially perpendicular to the centre axis y.

The rotor blade 3 is thus adapted to mounted to the rotor 2 in such a way that the first direction slopes from the leading end away from the rotary axis x, whereas the third direction slopes from the leading end towards the rotary axis x. The absolute values of the angles $\alpha$ and $\beta$ of the first and third directions, respectively, are substantially equal in the embodiment disclosed. The absolute value of the angles $\alpha$ and $\beta$ may be any value in the interval 30-80°, preferably in the interval 50-80°, and most preferably in the interval 60-70°. It should be noted, however, that the absolute value of the inclination angle of the first direction may be different from the one of the third direction in order to provide the best correspondence between the heat transfer on different sides of the blade 3.

As appears from FIG. 2, the first direction intersects with the third direction. Consequently, the first ribs 21 intersect with the second ribs 22 at a plurality of positions in the matrix 20 of channels. The first ribs 21 are directly connected or joined to the second ribs 22 where the ribs 21, 22 intersect each other without any intermediate element between the first ribs 21 and the second ribs 22. In particular, it is to be noted that the first ribs 21 and second ribs 22 intersect at an intersection joint 26 in the proximity of the trailing end of the matrix 20 of channels in such a way that the first channel 23 and the second channel 24 merge to form a common outlet channel 27 having a flow area. Each of the common outlet channels 27 has a height H measured from the first wall 11 to the second wall 12. Each of the first channels 23 and second channels 24 has a height h extending from the first wall 11 and second wall 12, respectively, to the second ribs 22 and first ribs 21, respectively. The total height available for the cooling fluid in the inner space appears from FIG. 3. Furthermore, it appears that the total height decreases from the distribution chamber 19 towards the trailing edge 14. Close to the outlet 18 where the first ribs 21 and the second ribs 22 extend in parallel to each other, the height H of the common channel thus corresponds to the total height of the inner space 10.

The first ribs 21 and the second ribs 22 have a main thickness along substantially all of their extension. However, the first ribs 21 and the second ribs 22 at the intersection joint 26 in the proximity of the trailing end have a thickness that is larger than the main thickness. Substantially each of the intersection joints 26 thus provides a thickened portion of the two merged ribs 21 and 22. The intersection joints 26 connect the pressure and suction sides of the blade 3. Each of the intersection joints 26 has a width B which may be from 1.1 to 3 times bigger than the width b of the main extension of the ribs 21, 22.

Figure 4:
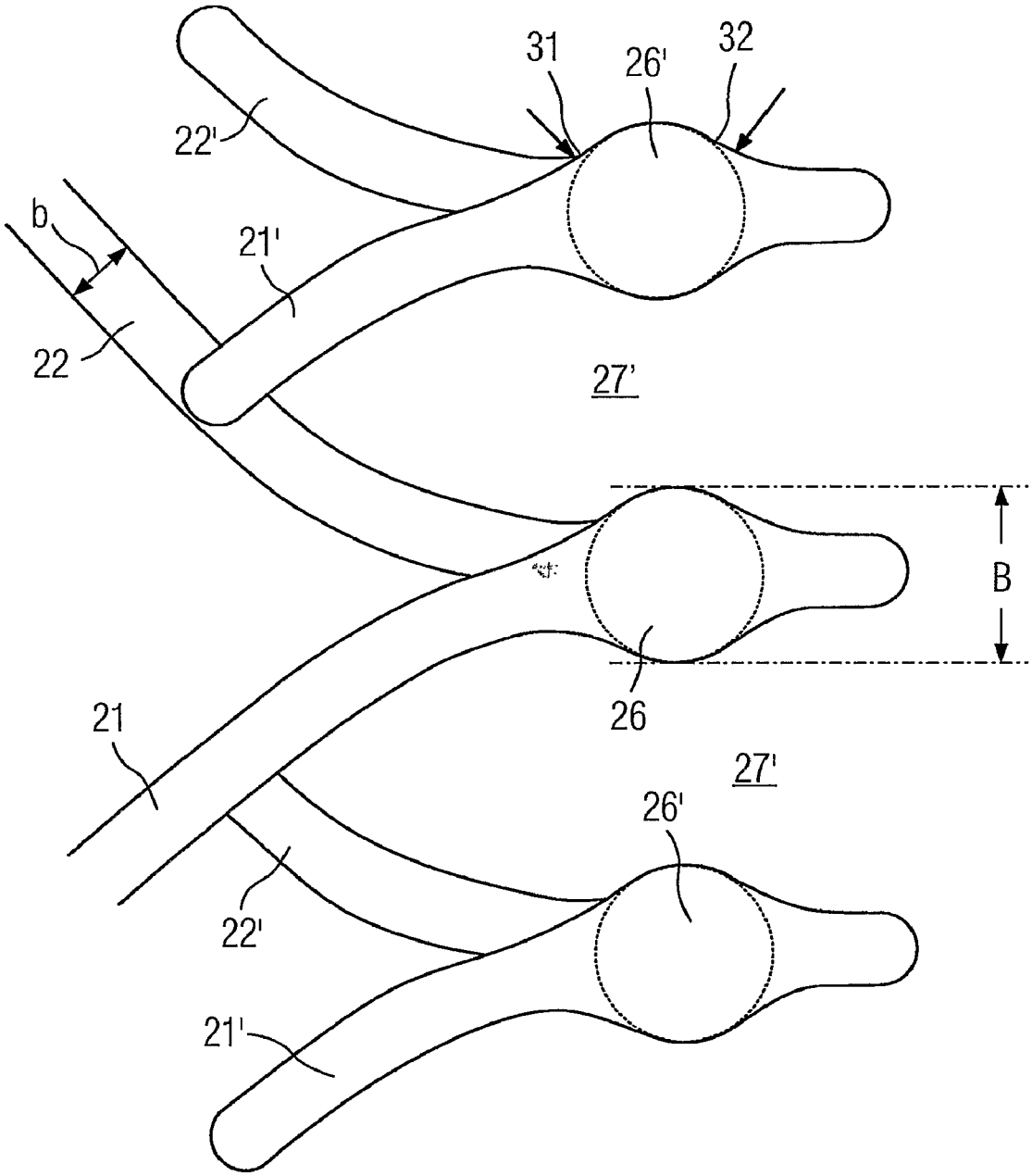
FIG. 4 shows enlarged sectional view of a part of the rotor blade in FIG. 2.

Each intersection joint 26 may be seen as a substantially cylindrical pin in the sectional view of FIG. 4. The cylindrical pin is connected to the respective rib 21, 22 via an upstream fillet 31 and a downstream fillet 32. The fillets 31 and 32 may have different radius, depending on the direction of the flow in the channel. It is suitable to make the radius of the upstream fillet 31 rather small, i.e. from (0.1*b) to (1*b) in order to increase the heat transfer, using the kinetic energy of the air. The radius the downstream fillet may be made bigger, e.g. from (0.1*b) to (1*b), thus creating the smooth expansion of the channel at its end. This reduces the losses directly after the intersection joints 26, creating high velocities at the outlet 18.

The matrix 20 of channels and thus the first ribs 21 and the second ribs 22 extend over a leading zone 35 adjoining the distribution chamber 19 and a trailing zone 36 adjoining the leading zone 35 and the outlet 18. Furthermore, the matrix 20 channels of the rotor blade 3 includes additional first ribs 21' projecting form the first wall 11 and extending substantially in parallel to each other over the trailing zone 36 to the trailing end. The additional first ribs 21' extend in parallel with the first ribs 21 in such a way that substantially every additional first rib 21' is provided between two respective adjacent first ribs 21, thereby dividing substantially every one of the first channels 23 into two parallel part channels 23' extending over the trailing zone 36. The matrix 20 of channels also includes additional second ribs 22' projecting form the second wall 12 and extending substantially in parallel to each other over the trailing zone 36 to the trailing end. The additional second ribs 22' extend in parallel with the second ribs 22 in such a way that substantially every additional second rib 22' is provided between two respective adjacent second ribs 22, thereby dividing substantially every one of the second channels 24 into two parallel part channels 24' extending over the trailing zone 36.

The additional ribs 21', 22' are substantially equal to the ribs 21, 22 except for the length, i.e. the additional ribs 21', 22' are significantly shorter than the ribs 21, 22. The additional ribs 21' 22', which are parallel to the ribs 21, 22, change their inclination angles $\alpha$ and $\beta$ respectively, starting at an angle ranging from 5°-60° on the leading edge side, and continuously changing to an angle of 0° on the trailing edge side. They connect with the ribs 21, 22 at the beginning of the trailing zone 36, where the inclination angle is biggest.

The additional ribs 21', 22' are substantially equal to the ribs 21, 22 except for the length, i.e. the additional ribs 21', 22' are significantly shorter than the ribs 21, 22. The additional ribs 21' 22', which are parallel to the ribs 21, 22, change their inclination angles continuously from 5°-60° to 0°. They connect with the ribs 21, 22 at the beginning of the trailing zone 36, where the inclination angle is biggest.

Figure 5:
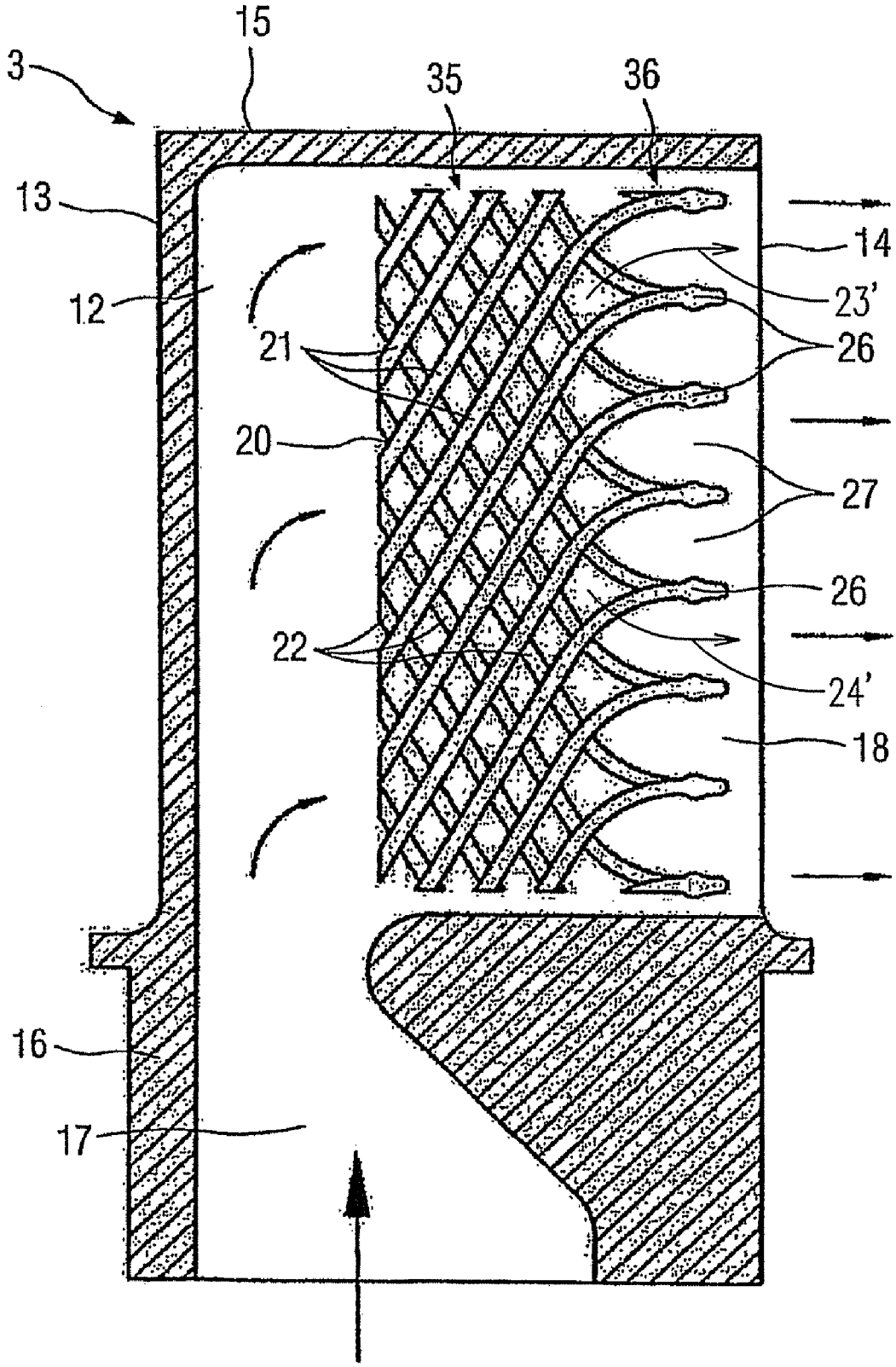
FIG. 5 shows an axial sectional view through a rotor blade according to another embodiment.

FIG. 5 discloses another embodiment of the rotor blade 3 which differs form the embodiment in FIGS. 2-4 in that the rotor blade has no additional ribs, or in other words all the ribs 21, 22 have substantially the same length except at the upper end and the lower and of the matrix 20.

The present invention is not limited to the embodiments describe but may be varied and modified within the scope of the following claims. For instance, the invention may be performed with the structure shown but without the thickening of the intersection joints.

The invention claimed is:

1. A blade or vane component with a basic airfoil shape for a rotary machine having a rotor mounted along a rotational axis of the machine, comprising:

an inner space defined by a first wall radially extending perpendicular to the rotor axis, a second wall arranged opposite the first wall, an inlet area arranged at a radially inward end of the first and second walls, a top area arranged opposite the inlet area and at a radially outer end of the first and second walls, and an outlet area arranged toward a trailing edge of the component, wherein the inner space forms a passage for a cooling fluid that flows from the inlet area toward the outlet area;

a plurality of first ribs projecting from the first wall, having a first rib extension extending substantially parallel to each other from a leading end of the first ribs to a trailing end of the first ribs, having a main thickness along a main portion of the first rib extension and a greater thickness at the trailing end of the first rib extension and forming a plurality of first channels in which the cooling fluid flows; and a plurality of second ribs projecting from the second wall, having a second rib extension extending from a leading end of the second ribs to a trailing end of the second ribs, having a main thickness along a main portion of the second rib extension and a greater thickness at the trailing end of the second rib extension and forming a plurality of second channels in which the cooling fluid flows, wherein the first rib extensions are directly connected to the second rib extensions where they intersect, wherein the first and second ribs intersect at intersection joints arranged in the trailing end of the component such that each intersection of the first and second channels forms a common outlet channel having a reduced flow area at the trailing edge due the increased rib thickness of the first and second ribs, and wherein each common outlet channel directs all the cooling fluid from the respective first and second channels out the trailing edge.

2. The component according to claim 1, wherein the plurality of first ribs each extend parallel to every first rib and the plurality of second ribs each extend parallel to every second rib.

3. The component according to claim 2, wherein the plurality of first ribs extend from the leading end to the trailing end along a first direction in the proximity of the leading end and along a second direction in the proximity of the trailing end and the first direction is inclined in relation to the second direction and the first direction forms a first angle of inclination with respect to the rotary axis of the rotor.

4. The component according to claim 3, wherein that the plurality of first ribs extend from the leading end to the trailing end along an essentially continuously curved path.

5. The component according to of claim 4, wherein the plurality of second ribs extend from the leading end to the trailing end along a third direction in the proximity of the leading end and along a fourth direction in the proximity of the trailing end, wherein the third direction is inclined in relation to the fourth direction and the third direction forms a third angle of inclination with respect to the rotary axis of the rotor.

6. The component according to claim 5, wherein the plurality of second ribs extend from the leading end to the trailing end along an essentially continuously curved path.

7. The component according to claim 6, wherein the second direction is essentially parallel the fourth direction.

8. The component according to claim 7, wherein the second direction and the fourth direction are substantially parallel to the rotary axis.

9. The component according to claim 8, wherein the first direction intersects the third direction.

10. The component according to claim 9, wherein the component is configured to mount to the rotor such that the third direction slopes from the leading end towards the rotary axis.

11. The component according to claim 10, wherein the component is configured to mount to the rotor such that the first direction slopes from the leading end away from the rotary axis.

12. The component according to claim 11, wherein the component is configured to mount to the rotor such that the plurality of first ribs are provided on a pressure side of the component and that the second ribs are provided on a suction side of the component.

13. The component according to claim 12, wherein the first and second ribs extend over a leading zone extending from the leading end and a trailing zone extending from the trailing end.

14. The component according to claim 13, wherein the component further includes additional first ribs projecting from the first wall and extending substantially parallel to the existing plurality of first ribs over the trailing zone to the trailing end, wherein the additional first ribs are arranged between the existing plurality of first ribs such that every first channel is divided into two parallel first part channels that extend over the trailing zone.

15. The component according to claim 14, wherein the component further includes additional second ribs projecting from the second wall and extending substantially parallel to existing plurality of second ribs over the trailing zone to the trailing end, wherein the additional second ribs are arranged between the existing plurality of second ribs such that every second channel is divided into two parallel second part channels that extend over the trailing zone.

16. The component according to claim 15, wherein the additional first and second ribs intersect at an intersection joint in the proximity of the trailing end such that one of the first part channels together with one of the second part channels forms a common outlet channel having a flow area.

17. The component according to claim 16, wherein the additional first and second ribs have a main thickness along a main portion of the respective rib extension and a greater respective rib at the intersection joint that reduces the flow area of the common channels.

18. The component according to claim 17, wherein the inner space includes a distribution chamber arranged between the inlet area and the leading end of the first and second ribs and configured to distribute the cooling fluid from the inlet to substantially all of the cooling channels.

19. The component according to claim 18, wherein the distribution chamber extends from the bottom portion to the top portion of the component.

* * * * *